United States Patent [19]

Yasui

[11] 4,317,288

[45] Mar. 2, 1982

[54] ARCHERY MOUNTING DEVICE AND SIGHT SUPPORT

[75] Inventor: Shozui Yasui, Tokyo, Japan

[73] Assignee: M. Yasui & Co. Ltd., Tokyo, Japan

[21] Appl. No.: 106,885

[22] Filed: Dec. 27, 1979

[51] Int. Cl.[3] ..... F41G 1/46

[52] U.S. Cl. ..... 33/265

[58] Field of Search ..... 33/265; 124/23 R, 26, 124/23 A

[56] References Cited

U.S. PATENT DOCUMENTS

| | | | |
|---|---|---|---|
| 2,982,026 | 5/1961 | Peterson | 33/265 |
| 3,488,853 | 1/1970 | Altier | 33/265 |
| 3,568,323 | 3/1971 | Lendway | 33/265 |
| 3,574,944 | 4/1971 | Reynolds | 33/265 |

*Primary Examiner*—William D. Martin, Jr.
*Attorney, Agent, or Firm*—Harlan P. Huebner

[57] ABSTRACT

A mounting device and sight support adapted to be mounted to the side of the handle of an archery bow including a mounting bracket fixed to the bow having a plurality of mounting positions vertically spaced one from the other and in vertical alignment. Attached to the mounting bracket is an elongated attachment member which extends horizontally or normal to the vertical plane of the mounting bracket and the elongated attachment member is horizontally shiftable on the bracket and includes a sight support for receiving a sight elevation adjustment mechanism which support is mounted normally vertical to the axis of the elongated attachment member. The elongated attachment member may be releasably mounted on any one of the vertical mounting positions of the mounting bracket dependent upon the distance the archer is from the target. The mounting device and sight support is reversible and may be mounted on the opposite sides of the bow depending upon whether the archer is right or left handed.

6 Claims, 5 Drawing Figures

ARCHERY MOUNTING DEVICE AND SIGHT SUPPORT

BACKGROUND OF THE INVENTION

This invention relates to adjustment mechanism for archery bow sights and more particularly to novel and a unique mounting device and sight support.

Elevation adjustment mechanism for archery bow sights have been provided heretofore in a number of different configurations. However, generally each of the sight mechanisms is fixedly mounted in one position relative to a vertical axis of the archery bow.

While it is true that there have been horizontal adjustment means for the elevational adjustment sights, there has never been a sight mechanism wherein not only is the sight bar and pin means adjusted vertically, but the entire combination can be vertically mounted at selected positions on the archery bow handle.

With the existing type elevation adjustment mechanisms, it has been necessary to use an extremely long sight guide bar means attached to a support member. The long sight guide bar is necessary so that an appropriate position of a sight pin member mounted thereon may be achieved dependent on the proper projectory for the arrow when fired. Such a device is necessarily much greater in weight and more cumbersome to use. This adds to the overall weight of the archery bow and can cause a decrease in shooting efficiency.

SUMMARY OF THE INVENTION

It is a basic concept of the mounting device and sight support of this invention to reduce the normal weight of the sight mechanism by in turn reducing the length of the sight support upon which the sight mechanism is mounted. Also, with the lighter sight support the weight of the mounting device can be reduced by using less material therein.

It is the further object of this invention to provide a mounting device and sight support which is mountable on the handle portion of an archery bow at selected positions one above another.

It is the further object of this invention to provide a mounting bracket to be attached to a bow handle wherein there are a number of mounting positions including protrustions extending outwardly from the mounting bracket and in parallel vertical alignment.

It is the further object of this invention to provide a mounting device with a mounting arm or attachment member which has a configuration complementary to the shape of the protrusions of the mounting positions so that it may be mounted on one of the protrusions and maintained in that position by appropriate locking means.

It is another object of this invention to provide a sight support at the end of said mounting arm or attachment member which is of a length, approximately one-third the length of said attachment member. Said sight support is adapted to receive sight mechanism including a sight pin which is vertically adjustable whereby an archer may look through the sight pin at the target to aim and assure the proper projectory for the arrow when fired at the target.

The foregoing and other advantages of this invention will appear from the following detailed description, taken in connection with the accompanying drawing of the preferred embodiments.

DESCRIPTION OF THE PREFERRED EMBODIMENT

Figure 1:
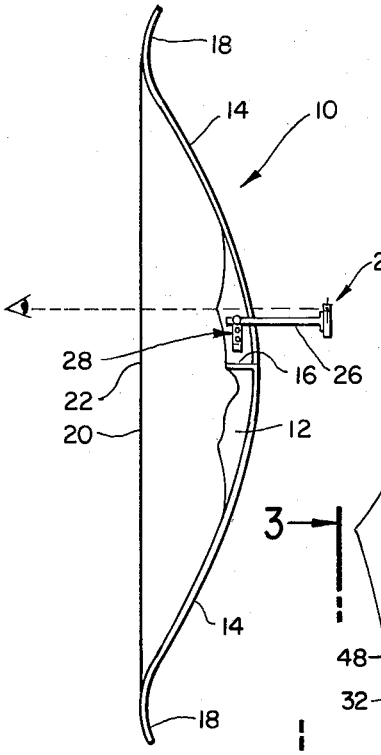
FIG. 1 is a side elevational view of an archery bow equipped with a mounting device and sight support embodying the features of this invention.

In FIG. 1 there is illustrated a conventional recurve archery bow generally designated 10 which includes a handle or grip 12 and a pair of limbs 14 extending outwardly and in opposite directions from the handle 12. The handle 12 includes an arrow rest 16. Extending between the tips 18 of the respective limbs 14 is a bow or draw string 20 which includes a nocking point 22 to receive the nock or end of an arrow (not shown). While the bow 10 illustrated is of the recurve type, the invention can be used on a Compound Bow with equal satisfactory results.

The mounting device and sight support generally designated 24 is mounted on the bow handle 12 on either the right or the left hand side of the handle 12 depending whether the archer is right or left handed. In the illustration of FIG. 1, the mounting device 24 is mounted on the right hand side for use by a right handed archer.

The mounting device and sight support mechanism 24 includes an elongated attachment member or mounting arm 26 adopted to be mounted on the side of the handle 12. For the purpose of mounting the same there is provided a mounting bracket generally designated 28. The mounting bracket 28 is provided with a pair of spaced countersunk openings 30 which extend there through for reception of the screws 32 which secure the mounting bracket 28 to the side of the bow handle 12.

Figure 2:
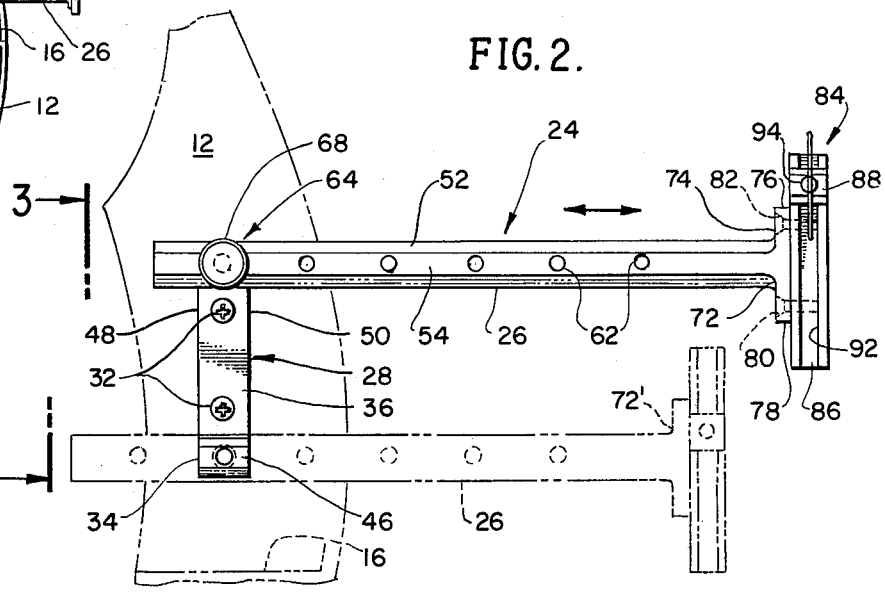
FIG. 2 is a side elevational view of the mounting device and sight support mounted in one position and in phantom mounted in an alternate position.
Figure 3:
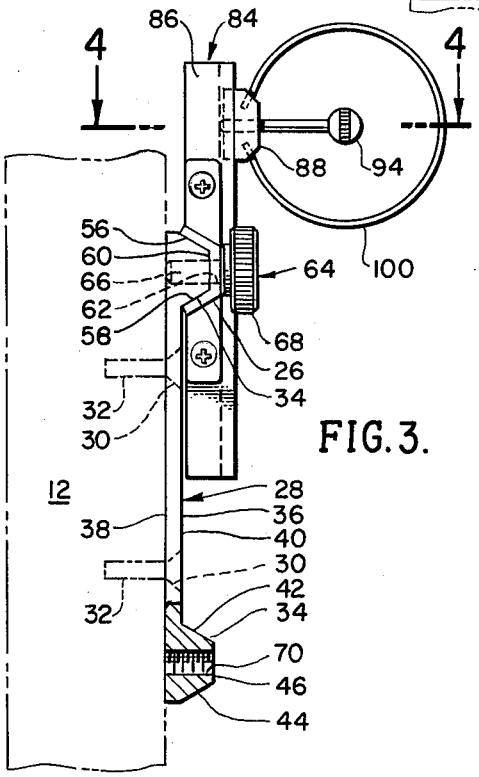
FIG. 3 is a view taken on line 3—3 of FIG. 2 showing the mounting device and sight support in an end view as an archer holding the bow would observe the invention.
Figure 4:
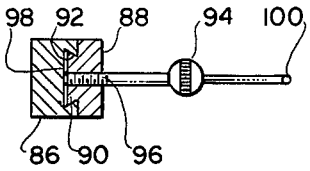
FIG. 4 is a sectional view taken on line 4—4 of FIG. 3 showing one form of a sighting mechanism mounted on the sight support.

The mounting bracket 28 also includes a plurality of vertical mounting positions generally designated 34 as best seen in FIGS. 2 and 3. The construction of the mounting bracket 28 is of metal or plastic and includes an elongated plate portion 36 having a rear wall 38 and front wall 40 in parallel relationship with each other. The rear wall 38 is relatively flat and fits flush against the side of the bow handle 12 as best seen in FIG. 3.

Projecting outwardly of the front wall 40 are the vertical mounting positions generally designated 34. These vertical mounting positions 34 are protrusions wherein each protrusion includes a pair of vertically spaced apart walls 42 and 44 respectively, wherein each of the walls 42 and 44 extend outwardly and converge toward each other terminating in a flat edge 46 generally parallel with the front wall 40 of the mounting bracket 28. In the preferred embodiment as illustrated in FIGS. 2 and 3, there are a pair of these vertical mounting positions 34, one at the bottom of the mounting bracket 28 and one at the top thereof. In addition to assure the necessary strength and appropriate mounting, each of these vertical mounting positions extend from one side 48 to the other side 50 of the mounting bracket 28.

The mounting bracket 28 as best seen in FIG. 2 is mounted vertically along the bow 10 which has a vertical axis along the handle 12 which would be parallel to the bow string 20 when in an at rest position such as seen in FIG. 1.

Turning now to the elongated attachment member or mounting arm 26, it may also be made of metal or relatively hard plastic. The attachment member 26 includes an elongated channel member 52 which includes a front surface 54. The channel member 52 has a cross-sectional shape rearwardly of the front surface 54 complimentary with the cross-section of one of the vertical mounting positions 34. In other words the channel member 52 is bent in the form of a lazy U as best seen in FIG. 3. The attachment member 24 includes a pair of inner walls 56 and 58 and a flat interior bottom wall 60 adapted to respectively contact the vertically spaced apart walls 42, 44 and flat edge 46 of the protrusions 34.

The channel member 52 includes a plurality of openings 62 extending from the front surface 54 through the wall into the generally U-shaped interior formed by the respective surfaces 56, 58 and 60. These openings are spaced along the channel member to assure positioning of the attachment member inwardly or outwardly from the handle 12. In order to mount the channel member 52 as shown in FIGS. 2 and 3, a threaded locking means 64 is provided. The locking means 64 includes a threaded bolt 66 and a knurled thumb screw 68. The threaded bolt 66 extends through the opening 62 into a threaded opening 70 of the protrusion 34.

The channel member 52 includes at its forward end 72 a bracket 74 which includes an upper arm 76 and lower arm 78 with bores 80 and 82 extending therethrough. The bracket 74 is adapted to be attached to a sight support generally designated 84. The sight support 84 includes a sight guide bar 86 which is normally of a length approximately one third the length of the channel member 52. The bar 86 as is seen in the drawings is vertically mounted to the bracket 72 parallel to the vertical axis of the bow 10.

Attached to the sight guide bar there is any form of conventional type of sight means for use by an archer in target practice or hunting. For purposes of illustration, there is shown in the drawings one form of such sight which includes a sight pin slide 88 which includes a rear dovetail extension 90 adapted to engage a dovetail groove 92 formed on the side of the sight guide bar 86. The dovetail groove 92 extends vertically the entire length of the sight guide bar 86. Extending outwardly from the sight pin slide 88, is a sight pin 94 which in the embodiment shown in the drawings includes a threaded end 96 extending through the sight guide bar 86 and is biased against the bottom 98 of the groove 92. In order to set the guide pin for the appropriate sighting between the eye of the archer and the target, the sight pin 94 is unscrewed and the sight guide bar 86 may be moved up and down vertically within the dovetail groove 92 to the desired position. At that point the sight pin 94 is rotated to threadably extend inwardly and biased against the sight guide bar 86 and fix the sight pin 94 in an appropriate position.

In addition, in order to complete the guide pin mechanism a circular bulls-eye ring of metal 100 may be formed to extend around the sight pin 94 and terminate in the sight pin slide 88 as best seen in FIG. 3.

Figure 5:
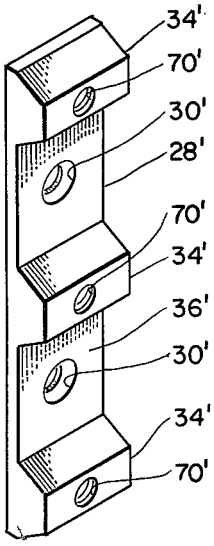
FIG. 5 is a prospective view of a modified mounting bracket for the mounting device and sight support of this invention.

In the modifications as shown in FIG. 5, there is illustrated a mounting bracket 28' with spaced countersunk openings 30'. In this modification the mounting bracket 28' includes three protrusions 34' each of the same configuration and each containing mounting bores 70'. As can be seen from FIG. 5, each of these protrusions 34' are parallel one with the other and when the plate 36' is mounted to the handle 12 of the bow 10, there will actually be 3 positions upon which the elongated attachment member or mounting arm 26 may be mounted.

It has been found that where the elongated attachment member 26 of the mounting device and sight support 24 can be adjusted vertically from a position such as shown in FIG. 2 to the ghosted position such as shown in the same Figure, the need for a relatively long sight guide bar 86 is eliminated.

In conventional sight mechanisms where the mounting brackets are fixedly mounted to the handle of a bow, it is necessary to increase the vertical length of the sight guide bar so as to accommodate varying attitudes of the bow depending upon the distance from the target. In other words with a vertically fixed mounting device where the target is relatively close to the archer, the conventional sight mechanism must be extremely long. In most cases the sight guide bar is as long as the horizontal arm extending outwardly from the bow handle. This is necessary so that the sight pin itself may be moved very high up vertically because of the trajectory of the arrow to be fired from the bow is of a lesser trajectory than where it would be if the target is at a greater distance. When the target is, of course, at a greater distance from the archer than was previously suggested, then the trajectory of the arrow must be greater and therefore it is necessary to tip the bow farther from the vertical back toward the archer and in that case the guide pin must be moved downward on the sight guide bar toward the bottom.

With relatively long sight guide bars the weight of the bow is increased and a detriment to the archer.

As can be seen from the present invention, with the mounting device and sight support 24 capable of being moved vertically up and down on the bow handle 12, from one of the protrusions 34 to any one of the protrusions on the mounting bracket 28, the need for a long sight guide bar is eliminated. Also, it has been found that with the vertical adjustability of the mounting device and sight support 24 on the handle 12, it is also unnecessary to increase the thickness of the channel member 52. Actually with the reduced length of the sight support the thickness of the channel member 52 may be reduced. This again will help to eliminate the total weight of the sighting device. Thus, with reduced weight the accuracy of the aim of the archer will be increased.

The invention and its attendant advantages will be understood from the foregoing description and it will be apparent that various changes may be made in the form, construction and arrangements of the parts of the invention without departing from the spirit and scope thereof or sacrificing its material advantages, the arrangements hereinbefore described being merely by way of example. I do not wish to be restricted to the specific forms shown or uses mentioned except as defined in the accompanying claims, wherein various portions have been separated for clarity of reading and not for emphasis.

I claim:

1. A mounting device and sight support adapted to be mounted on an archery bow for visually aiming an arrow at a target wherein said bow includes a handle member having a vertical axis and limbs including tips, said limbs extending from said handle in opposed directions and a bow string extending between the respective limb tips, said mounting device and sight support including:

a mounting bracket adapted to be fixedly secured to either side of said handle member and having a plurality of predetermined vertically aligned spaced apart mounting positions and including a plate having a relatively flat back wall for contacting said handle, a front wall parallel to said back wall broken by a plurality of protrusions extending outwardly of said front wall forming said mounting positions, and each of said protrusions having a threaded bore extending into said plate;

an elongated attachment member having predetermined horizontal mounting positions for securing said member to one of said mounting positions on said bracket dependent upon the trajectory desired for said arrow during flight, and said elongated attachment member having a free end and an opposite end terminating in end attaching means for a sight mechanism;

a sight support attached to said end attaching means and said sight support includes a vertical elevation sight guide bar extending parallel to said vertical axis of said handle and adapted to receive an adjustable sight member and said sight guide bar is of a length less than the length of said elongated attachment member; and locking means for releasably retaining said elongated attachment member to said mounting bracket.

2. A mounting device and sight support as defined in claim 1, wherein each of said protrusions comprise a ridge extending the width of said plate and normal to said vertical axis of said handle member, and wherein each of said ridges is formed by spaced apart outwardly extending converging walls terminating in a flat edge spaced from and parallel with said front wall.

3. A mounting device and sight support as defined in claim 1, wherein said elongated attachment member includes a front and rear surface;

a channel in said rear surface extending the entire length thereof; said channel having a cross-sectional shape complimentary with the cross-sectional shape of said ridges and mountable on one of said ridges;

openings extending through said front surface of said member into said channel; and said locking means including a threadable locking knob extending through one of said openings to lock said attachment member to said mounting bracket;

4. A mounting device and sight support as defined in claim 1 wherein said sight guide bar has a length approximately one-third the length of said elongated attachment member.

5. A mounting device and sight support as defined in claim 3 wherein there are two ridges, one adjacent the bottom of said mounting bracket and a second adjacent the top of said mounting bracket, whereby said elongated attachment member may be selectively fixed to said mounting bracket in one of said mounting positions dependent on the distance from said target.

6. A mounting device and sight support as defined in claim 2 wherein there are a plurality of ridges one of which is adjacent the bottom of said mounting bracket and a second of which is adjacent the top of said mounting bracket with at least one additional ridge spaced therebetween whereby said elongated attachment member may be selectively fixed to said mounting bracket in one of said mounting positions dependent on the distance from said target.

* * * * *